United States Patent [19]

Ponsi

[11] Patent Number: 5,002,197

[45] Date of Patent: Mar. 26, 1991

[54] CONTAINER WITH SLIDING SEAL

[75] Inventor: Lawrence G. Ponsi, Wheeling, Ill.

[73] Assignee: Sage Products, Inc., Cary, Ill.

[21] Appl. No.: 545,366

[22] Filed: Jun. 28, 1990

[51] Int. Cl.[5] ..... B65D 43/16

[52] U.S. Cl. ..... 220/254; 220/339; 220/259

[58] Field of Search ..... 220/254, 255, 256, 259, 220/263, 339, 344, 356, 357, 361

[56] References Cited

U.S. PATENT DOCUMENTS

| | | | |
|---|---|---|---|
| 1,763,907 | 6/1930 | Sommers | 220/255 |
| 3,782,583 | 1/1974 | Abbey | 220/339 |
| 3,893,566 | 7/1975 | Ross | 220/259 X |
| 4,144,985 | 3/1979 | Kinslow | 220/339 X |
| 4,401,229 | 8/1983 | Bell et al. | 220/259 |
| 4,714,168 | 12/1987 | Johnson et al. | 220/255 X |
| 4,813,753 | 3/1989 | Relyea | 220/259 X |
| 4,874,103 | 10/1989 | Quisenberry et al. | 220/254 X |

*Primary Examiner*—Stephen Marcus
*Assistant Examiner*—Vanessa M. Roberts
*Attorney, Agent, or Firm*—Lee, Mann, Smith, McWilliams & Sweeney

[57] ABSTRACT

A sliding seal for the closure of a container. The closure is of the type having a portion fixed to the container and a portion hingedly secured thereto for permitting access to the interior of the container. The seal has a first segment secured to the fixed portion of the closure and a second segment extending from the first and slidably connected to the pivotal portion of the closure by means of a post secured to the pivotal portion and extending through a slot formed in the second segment. The post is capped by a washer or the like to retain the second seal segment about the post. The seal is otherwise unattached to the pivotal portion of the closure, and therefore slides relative to the pivotal portion to prevent stretching of the seal as the closure is opened.

14 Claims, 2 Drawing Sheets

CONTAINER WITH SLIDING SEAL

BACKGROUND OF THE INVENTION

This invention relates to containers for waste, such as medical waste, and in particular to a container having a closure with a pivotal portion which, when closed, may be substantially sealed to the container to prevent leakage.

Medical waste is often a biological hazard, and it is important that medical waste be appropriately disposed of to prevent contamination and possible spread of disease. Thus, most medical containers for disposal of needles, syringes, sponges, gloves and other disposable waste have a closure of some sort so that once the container has been filled, further access is prevented, and the container may then be properly discarded.

One problem with disposal of medical waste is that some medical waste includes fluids. Thus, it is important that the waste container have a seal of some integrity when the container is closed so that the fluids will not leak from the container.

Typically, containers having a pivotal, hinge-type closure have some type of seal affixed to the closure so that when the closure is closed on its associated container, the seal effects an appropriate leak-tight barrier for the container. Often, because of costs, the seal is closed-cell foam gasket which is laid in the underside of the closure for the container and affixed thereto, whether by adhesives, holding in place by extending posts, or otherwise.

When such foam seals are used for a pivotal closure, it has been found that since the closure has a portion which is hingedly pivoted relative to the remainder of the closure, the seal, which adheres to the underside of the closure, stretches as the closure is pivoted. When it stretches, it becomes dimensionally thinner, and when the closure is locked in place for disposal, often the thinned portion of the seal will leak fluids contained within the sealed container. This result is highly unacceptable, and thus pivotal closures often cannot be used where liquid waste is involved, unless complex or expensive seals are used which do not stretch or otherwise lose any of the integrity of the seal when the closure is pivoted.

SUMMARY OF THE INVENTION

The invention pertains to a seal for a closure for a container, the closure being of the type having a fixed portion attached to the container and a pivotal portion hingedly associated with the fixed portion for permitting access to the interior of the container. The seal comprises a first seal segment secured to the fixed portion and sandwiched between the fixed portion and the container to form a seal therebetween. The seal has a second seal segment extending from the first seal segment and means is provided for movably coupling the second seal segment to the pivotal portion of the closure such that the second segment may shift relative to the pivotal portion as the pivotal portion is pivoted in order to prevent stretching of the second seal segment.

In accordance with the preferred form of the invention, the means movably coupling the second seal segment to the pivotal portion of the closure comprises a longitudinal slot in the second seal segment and a post attached to the pivotal portion. The post extends through the slot and includes a washer affixed thereto to retain the second seal segment about the post. The washer has a diameter greater than the width of the slot to securely retain the second seal segment in place.

In accordance with the illustrated form of the invention, the second seal segment is substantially co-extensive with the pivotal portion of the closure, although only a peripheral seal is required to effect a leak-tight junction between the closure and the container.

The seal segments are integral portions of a flexible, closed cell foam forming the seal. The first seal segment may be advisely secured to the fixed portion of the closure, or may simply be held in place by posts, guides and snap members that are used to secure the closure to the container.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
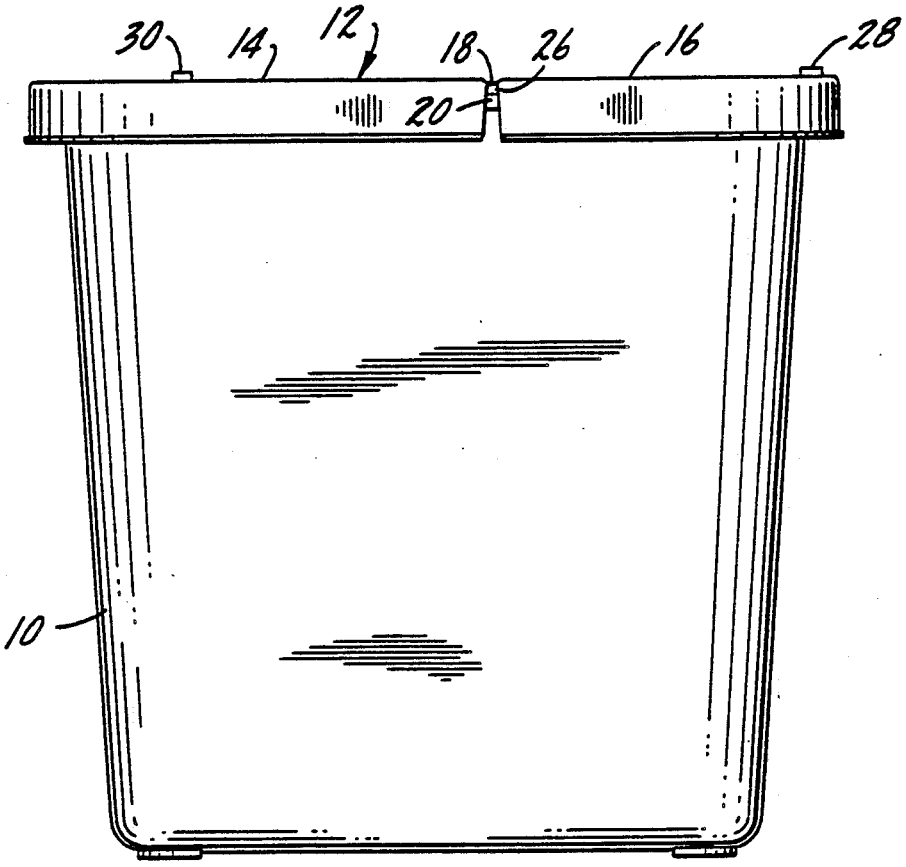
FIG. 1 is a side elevational illustration of a container according to the invention with the closure applied thereto and snapped closed.

One form of the invention is illustrated in the drawing figures. It comprises a container 10 having a closure 12 affixed thereto. The closure 12 comprises two portions, a fixed portion 14 attached to the container 10, and a pivotal portion 16 hingedly secured to the fixed portion 14 by means of a living hinge 18. The container 10 and closure 12 are preferably molded from plastic.

Figure 5:
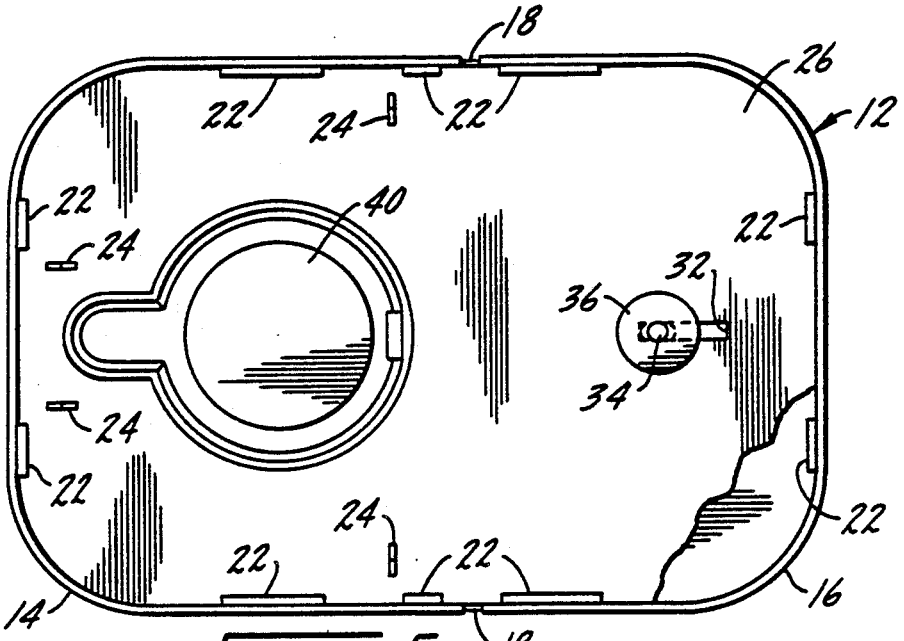
FIG. 5 is a view of the underside of the closure of the invention, with a portion of the seal broken away for purposes of illustration.

The container 10, as is conventional, includes a peripheral lip 20 to which the closure 12 is secured. As best shown in FIG. 5, the closure 12 includes a series of snap elements 22 and guides 24 formed therein to accommodate the lip 20 with the snap elements snapping over the lip 20 to secure the closure 12 thereto when the closure 12 is applied to the container 10.

A gasket-like seal 26 is employed to form a seal between the container 10 and closure 12. The seal 26 is preferably formed of a closed-cell foam, which is simple to mold, inexpensive, and which forms an excellent seal when compressed between the closure 12 and lip 20 of the container 10.

Figure 3:
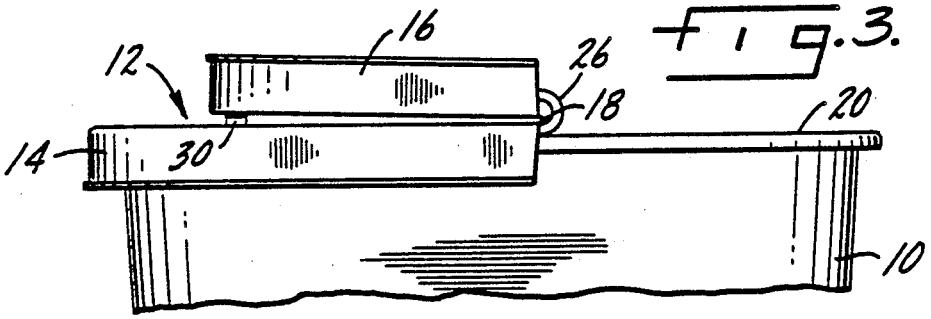
FIG. 3 is a partial side elevational illustration similar to FIG. 1, but with the pivotal portion of the closure pivoted back and locked to the fixed portion of the closure.
Figure 4:
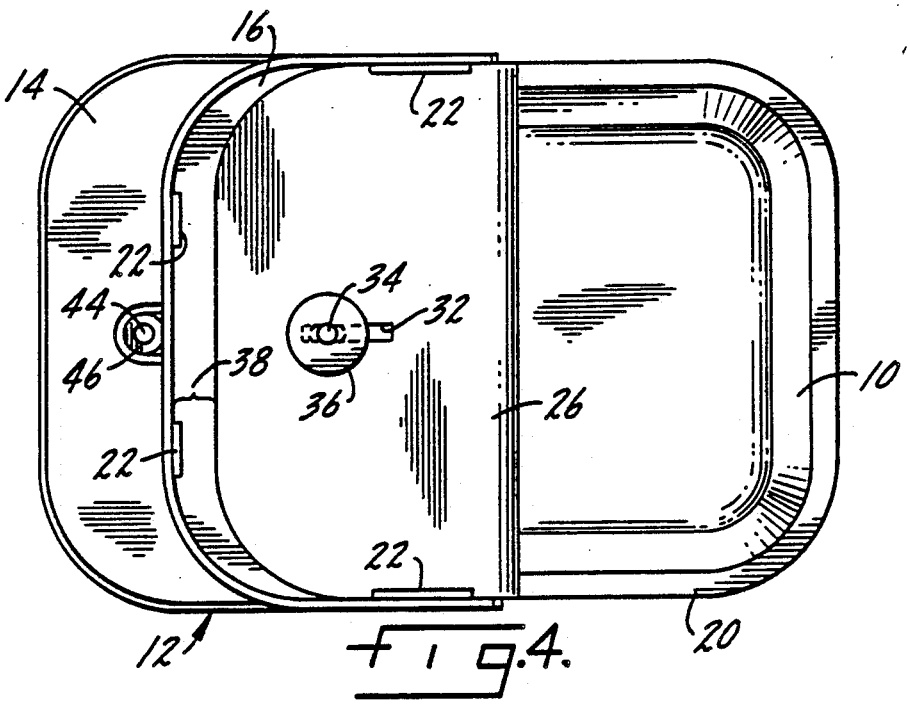
FIG. 4 is a top plan view of the invention as illustrated in FIG. 3.

As shown in FIGS. 3 and 4, the pivotal portion 16 of the closure 12 may be pivoted to lie substantially co-extensive with and above the fixed portion 14 of the closure 12, in order to permit access to the interior of the container 10. The pivotal portion 16 and fixed portion 14 are provided with respective interlocking legs 28 and 30 which interengage when the closure is opened to the extent shown in FIGS. 3 and 4 so that the pivotal portion is held in place.

The seal 26 is sandwiched between the fixed portion 14 of the closure 12 and the container 10 when the closure 12 is applied to the container 10. The pivotal portion 16 is then opened and snapped in place as illustrated in FIG. 3 and 4. Were the seal 26 adhesively secured to the underside of the closure 12, the seal 26 would stretch at the hinge 18 when the pivotal portion 16 is opened. It has been found that such stretching permanently thins the seal 26 at the hinge 18, allowing leakage of fluids from the container 10 when the closure 12 is ultimately sealed thereto after pivoting of the pivotal portion 16 to the orientation shown in FIG. 1.

To prevent stretching of the seal 26, the seal 26 is unaffixed to the pivotal portion 16 of the closure 12, and includes a slot 32 through which a post 34 extends. The post 34 is secured to the pivotal portion 16, either by adhesives, sonic welding, or forming a part of the pivotal portion 16 as it is molded. The post 34 is capped by a washer 36 which, as illustrated, has a diameter significantly larger than the width of the slot 32 to assure that the seal 26 is always slidingly secured to the pivotal portion 16 of the closure. The washer 36 is appropriately affixed to the post 34 in any conventional manner.

The seal 26 may be secured to the underside of the fixed portion 14 of the closure 12, or may simply be held in place by the combination of the guides 24 protruding therethrough and the snap elements 22. The seal is only slidingly secured to the pivotal portion 16 by means of the slot 32, post 34 and washer 36 combination, thus permitting the seal 26 to slide somewhat as the pivotal portion 16 is opened to the orientation shown in FIGS. 3 and 4. Unlike the prior art, when the closure is opened, the seal 26 does not have a severe bend like the hinge 18, but rather bows about and gently bends around the hinge 18 as shown in FIG. 3. The gentle bowing and bending permitted by the slot 32 prevents stretching of the seal 26 when the pivotal portion 16 is opened. The extent of the displacement of the seal 26 permitted by the slot 32 and post 34 is illustrated in FIG. 4, a gap 38 having been formed when the pivotal portion is folded back, with the gap 38 disappearing altogether when the pivotal portion 16 and fixed portion 14 are in registration, as illustrated in FIG. 5.

Figure 2:
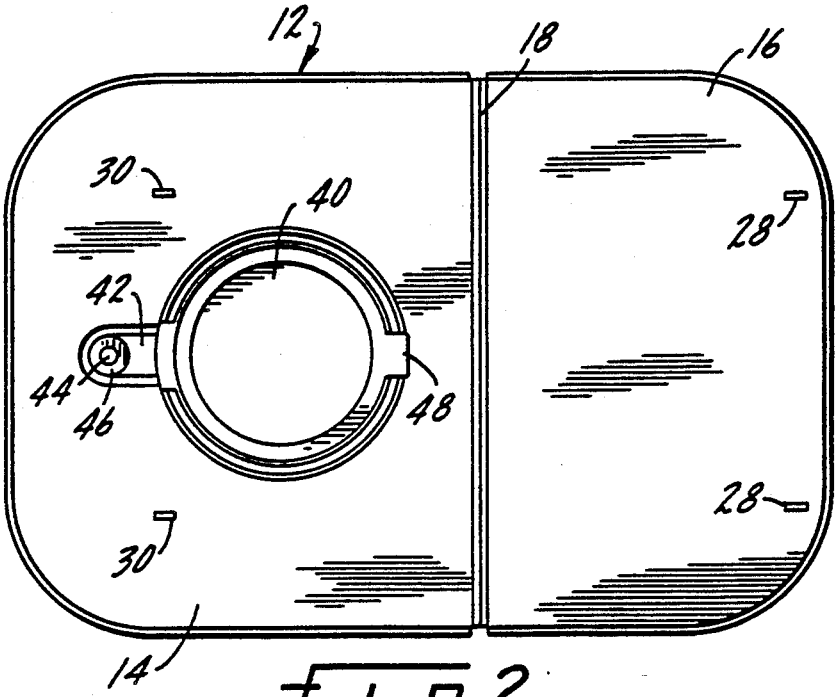
FIG. 2 is a top plan view of the invention as illustrated in FIG. 1.

In addition to the pivotal portion 16, the closure 12 may also include other means to gain access to the interior of the container 10. As illustrated in FIGS. 2 and 5, the closure 12 may also include a cap 40 having an extending arm 42 secured to the closure 12 by a post 44 and washer 46. A tab 48 extends from the cap 40 to facilitate opening. The cap 40 and its means of formation and attachment to the closure 12 may be conventional, and form no part of the invention.

The slidable seal 26 forms a simple yet effective seal for assuring a leak-tight barrier between the closure 12 and container 10 when the pivotal portion 16 is snapped onto the container 10 as shown in FIG. 1. Because the seal 26 does not stretch in the vicinity of the hinge 18, the pivotal portion 16 can be fully opened to the orientation shown in FIGS. 3 and 4 without fear of stretching of the seal and adversely affecting the integrity of the seal when the closure 12 is ultimately snapped onto the container 10 for the final time.

Various changes can be made to the invention without departing from the spirit thereof. For example, for particularly large containers 10 and closures 12, more than one slot 32, post 34 and washer 36 combination may be necessary to properly orient the seal 26. Also, other means of slidably securing the seal 26 to the pivotal portion 16 may be employed. The scope of the invention is determined by the following claims.

What is claimed is:

1. A seal for a closure for a container, the closure having a fixed portion attached to the container and a pivotal portion hingedly associated with the fixed portion for permitting access to the interior of the container, the seal comprising a. a first seal segment secured to said fixed portion and sandwiched between said fixed portion and said container to form a seal therebetween;

b. a second seal segment extending from said first seal segment, and c. means movably coupling said second seal segment to said pivotal portion such that said second seal segment may shift relative to said pivotal portion as said pivotal portion is pivoted in order to prevent stretching of said second seal segment.

2. A seal according to claim 1 in which seal segments are integral.

3. A seal according to claim 1 in which said pivotal portion is secured to said fixed portion by a living hinge.

4. A seal according to claim 1 in which said first seal segment is adhesively secured to said fixed portion.

5. A seal according to claim 1 in which said means movably coupling comprises a longitudinal slot in said second seal segment, and a post attached to said pivotal portion and extending through said slot, and including means to retain said second seal segment about said post.

6. A seal according to claim 5 in which said means to retain comprises a washer affixed to said post, said washer having a diameter greater than the width of said slot.

7. A seal according to claim 6 in which said second seal segment is substantially coextensive with said pivotal portion.

8. A seal according to claim 1 in which said second seal segment is substantially coextensive with said pivotal portion.

9. A seal according to claim 1 in which said seal comprises a flexible, closed cell foam.

10. A flexible seal for a closure for a container, the closure having fixed portion attached to the container and a pivotal portion hingedly secured to the fixed portion, the seal comprising a. a first seal segment secured to said fixed portion and sandwiched between said fixed portion and said container to form a seal therebetween.

b. a second seal segment integral to said first seal segment and extending therefrom, c. means movably coupling said second seal segment to said pivotal portion such that said second seal segment may shift relative to said pivotal portion as said pivotal portion is pivoted in order to prevent stetching of said second seal segment.

11. A seal according to claim 10 in which said pivotal portion is secured to said fixed portion by a living hinge.

12. A seal according to claim 10 in which said means movably coupling comprises a longitudinal slot in said second seal segment, and a post attached to said pivotal portion and extending through said slot, and including means to retain said second seal segment about said post.

13. A seal according to claim 12 in which said means to retain comprises a washer affixed to said post, said washer having a diameter greater than the width of said slot.

14. A seal according to claim 13 in which said second seal segment is substantially coextensive with said pivotal portion.

* * * * *